US005111212A

United States Patent [19]

DeSatnick et al.

[11] Patent Number: 5,111,212

[45] Date of Patent: May 5, 1992

[54] RADAR ANTENNA MOUNT

[75] Inventors: Allen H. DeSatnick; Paul A. Torrie; Thomas D. Egan, all of Marblehead, Mass.

[73] Assignee: Questus Corporation, Marblehead, Mass.

[21] Appl. No.: 472,017

[22] Filed: Jan. 30, 1990

[51] Int. Cl.[5] ..... H01Q 1/34

[52] U.S. Cl. ..... 343/709; 343/878; 343/892

[58] Field of Search ..... 343/709, 888, 878, 892; 248/202.1, 218.4, 219.2, 302, 175; 114/90, 102

[56] References Cited

U.S. PATENT DOCUMENTS

| | | | |
|---|---|---|---|
| 1,569,325 | 1/1926 | Lieb | 342/428 |
| 3,026,121 | 3/1962 | Ellam | 114/102 |
| 3,229,295 | 1/1966 | Watkin et al. | 343/709 |
| 3,860,931 | 1/1975 | Pope et al. | 343/709 |
| 3,865,061 | 2/1975 | Newman | 114/90 |
| 3,968,496 | 7/1976 | Brunvoll | 343/765 |
| 4,609,083 | 9/1986 | Stuhler | 343/709 |
| 4,829,927 | 5/1989 | Berret et al. | 114/90 |

FOREIGN PATENT DOCUMENTS

| | | | |
|---|---|---|---|
| 2702340 | 7/1978 | Fed. Rep. of Germany . | |
| 8105622 | 7/1983 | Netherlands | 343/709 |

*Primary Examiner*—Michael C. Wimer
*Assistant Examiner*—Hoanganh Le
*Attorney, Agent, or Firm*—Henry D. Pahl, Jr.

[57] ABSTRACT

The mount disclosed herein facilitates the mounting of a radar antenna on a sailboat subject to heeling. A pivotable bracket providing a single horizontal axis of rotation only is supported on the upper end of a tube which surrounds the lower portion of the usual sailboat backstay, the tube preventing rotation around the backstay. The antenna is mounted with its center of gravity below the pivot axis and viscous damping is provided to prevent uncontrolled swinging of the antenna.

12 Claims, 4 Drawing Sheets

RADAR ANTENNA MOUNT

BACKGROUND OF THE INVENTION

The present invention relates to a self-leveling mount for a radar antenna and more particularly to such a mount which facilitates the use of radar equipment on a sailing vessel subject to heeling.

While self-leveling antenna mounts have been proposed at various times, these prior art arrangements are not well suited for use on sailboats. Rather, these mounts have typically been adapted for use on naval warships and have provided multiple degrees of freedom which could engender uncontrolled swinging in a small sailing vessel under way. Heretofore, most antenna mounts available for sailboats have provided fixed mounting of the antenna. In order to accommodate some heeling and pitching, the antennas themselves have been designed to generate a relatively large vertical beam width, e.g., 24 degrees, sacrificing gain to do so. Further, the antennas were typically mounted on the sailboat mast or on a separate freestanding post provided solely for that purpose. Mast installation engenders a number of problems including the threading of the necessary connecting cables and the possible fouling of jib and spinnaker rigging.

Among the several objects of the present invention may be noted the provision of apparatus for the mounting of a radar antenna on a sailing vessel; the provision of such apparatus which allows the antenna to be self-leveling on a vessel subject to heeling; the provision of such apparatus which does not subject the antenna to uncontrolled swinging; the provision of such apparatus which permits a radar antenna to be relatively easily installed; the provision of apparatus which facilitates the mounting of an antenna away from the mast without requiring the installation of a separate free-standing post; the provision of such apparatus which facilitates the use of relatively high gain antennas; the provision of such apparatus which is durable and highly reliable; the provision of such apparatus which is of relatively simple and inexpensive construction Other objects will be in part apparent and in part pointed out hereinafter

SUMMARY OF THE INVENTION

In accordance with one aspect, the present invention involves a self-levelling mount for installing a radar antenna on a sailing vessel subject to heeling A shaft is supported on a fore-and-aft horizontal axis relative to the vessel A housing is pivotally mounted on the shaft and forms an annular chamber around at least a portion of the shaft, the chamber being filled with a viscous liquid A vane on the shaft divides the chamber into two regions, the relative sizes of which vary as a function of the angular position of the housing relative to the shaft, there being restricted communication between the regions. The antenna is mounted on one of the shaft or housing and the other is fixedly attached to the vessel with the center of gravity of the antenna being below the shaft axis Accordingly, a single degree of freedom of motion is provided for permitting the antenna to self-level with respect to heeling but not to swing uncontrollably.

In accordance with another aspect of the invention, the antenna is mounted at the upper end of a tube which surrounds the lower portion of the usual sailboat backstay, the lower end of the tube being secured to the stern of the vessel to prevent rotation around the backstay.

DESCRIPTION OF THE PREFERRED EMBODIMENTS

Figure 1:
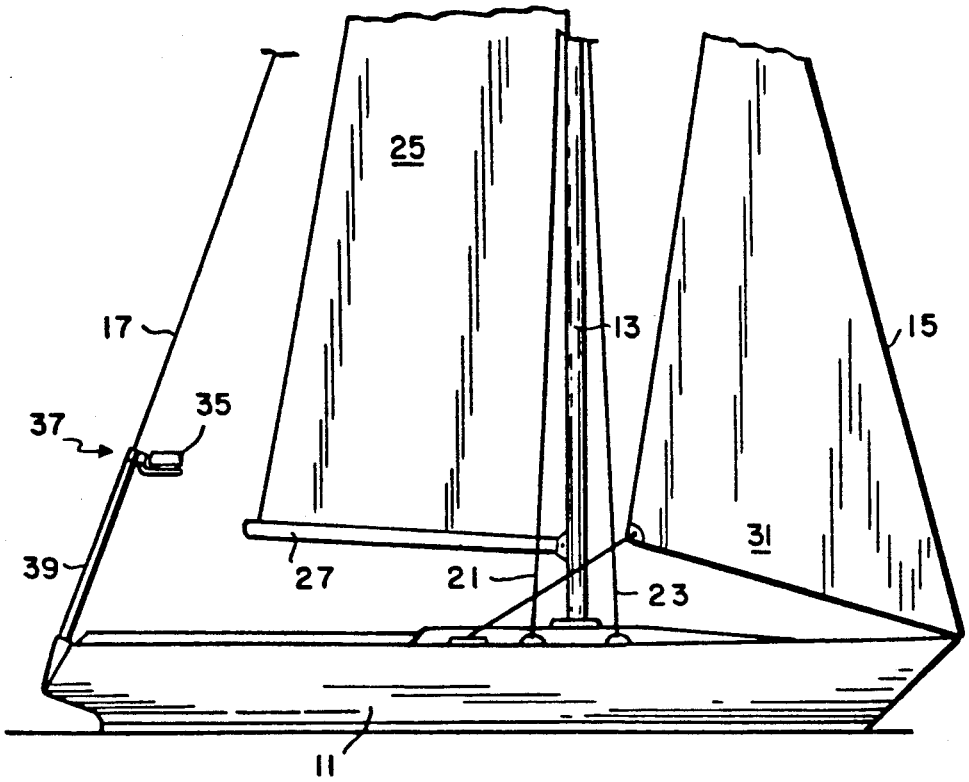
FIG. 1 is an overall view from the side of a cruising sailboat having a radar antenna mounted in accordance with the present invention.

Referring now to FIG. 1, there is illustrated a typical cruising sailboat including a hull 11 carrying a mast 13 supported by a headstay 15, a backstay 17 and shrouds 21-23. A mainsail is designated generally by reference character 25 and is controlled by a boom 27. Similarly, a jib sail is indicated by reference character 31.

In accordance with one aspect of the present invention, a somewhat disk-like radar antenna assembly 35 is mounted off backstay 17 by means of a bracket assembly, designated generally by reference character 37, which is in turn supported on a tube 39 which surrounds the lower portion of the backstay. The lower end of the tube 39 is fixed to the stern of the hull 11. The tube 39 and bracket assembly 37 are thus prevented from rotating around the stay 17.

Mounting of a radar antenna off the backstay in this manner is aesthetically pleasing and avoids many of the problems associated with mast mounting, e.g. cable threading and possible fouling of running rigging. It should thus be understood that this form of mounting may be advantageously employed even without the self-leveling feature described hereinafter.

Figure 2:
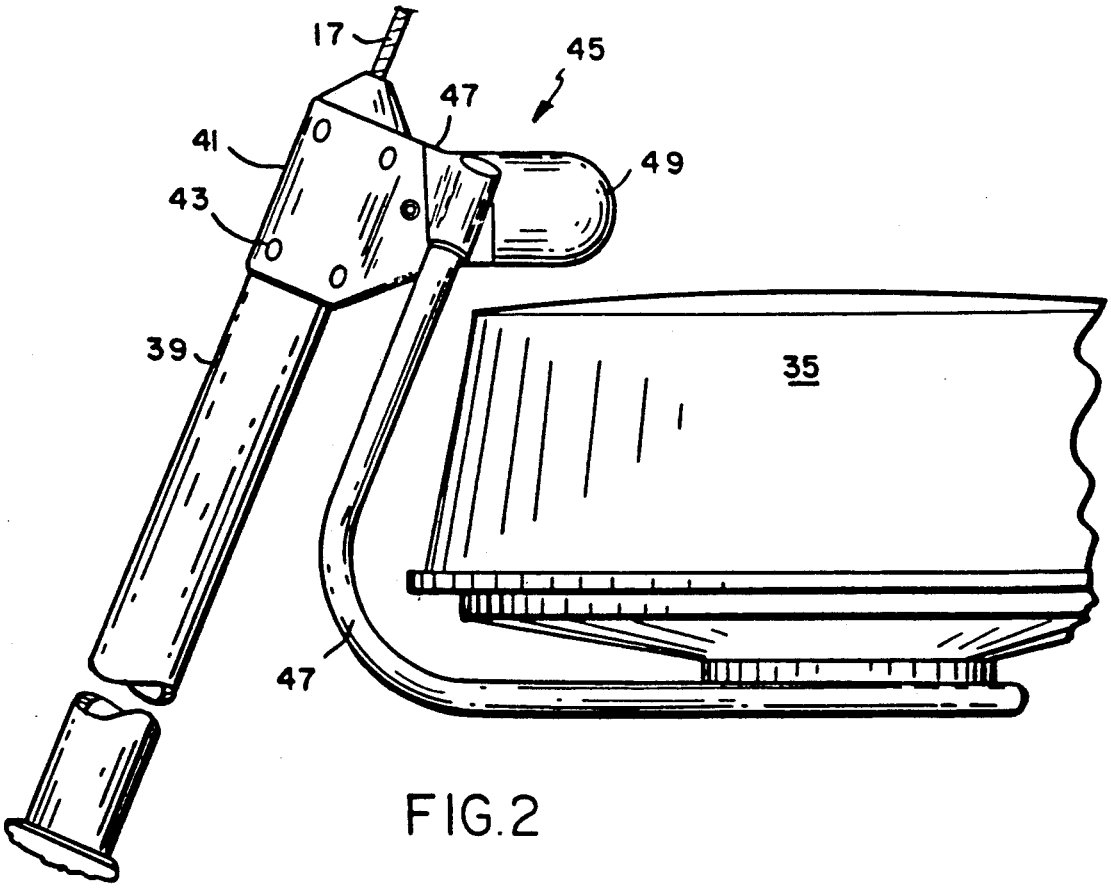
FIG. 2 is a side view to enlarged scale showing the antenna mount of FIG. 1.
Figure 5:
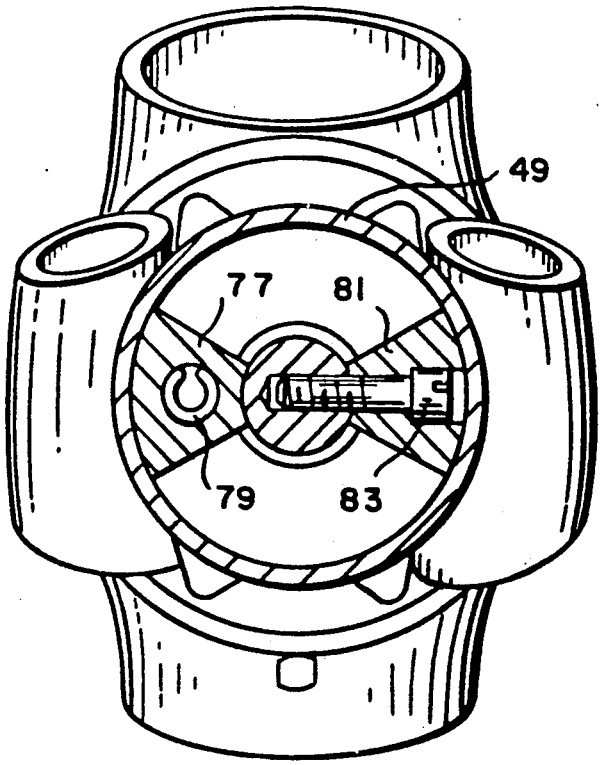
FIG. 5 is a section taken substantially on the line 5-5 of FIG. 3.
Figure 6:
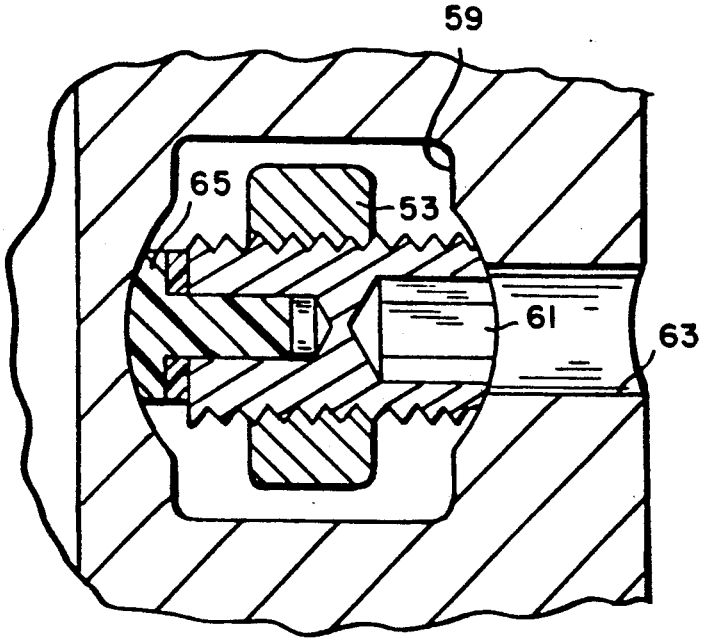
FIG. 6 is a section taken substantially on line 6-6 of FIG. 3.

FIG. 2 illustrates the bracket and tube assembly in somewhat greater detail. As may be seen, the bracket assembly includes a fixed cap or base 41 which is secured to the upper end of tube 39. Extending forward of the base 41 is a housing assembly 45 which, by virtue of a construction described hereinafter, is rotatable around a single horizontal axis with respect to the fixed base 41. The rotatable housing assembly 45 his formed in two parts, a rearward part 47 and a forward part 49 which is secured to the rearward part (FIG. 5). A formed tubular bracket 47 extends initially downwardly from sockets in the rearward part of the rotatable housing and then forwardly in a flat loop shape which forms a platform for mounting the radar antenna 35.

Figure 3:
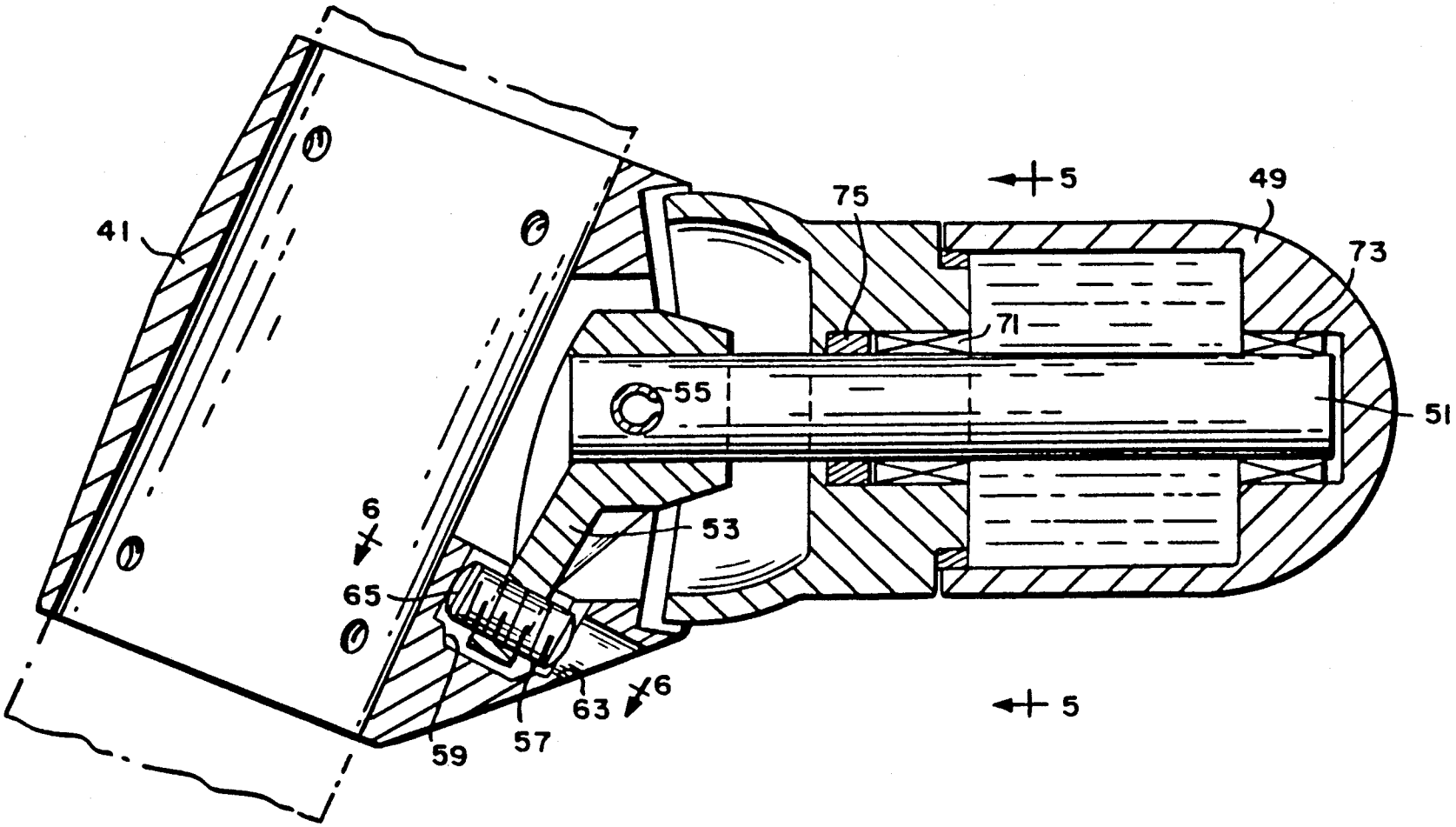
FIG. 3 is a sectional view to further enlarged scale of a bracket assembly employed in the apparatus of FIG. 2.
Figure 4:
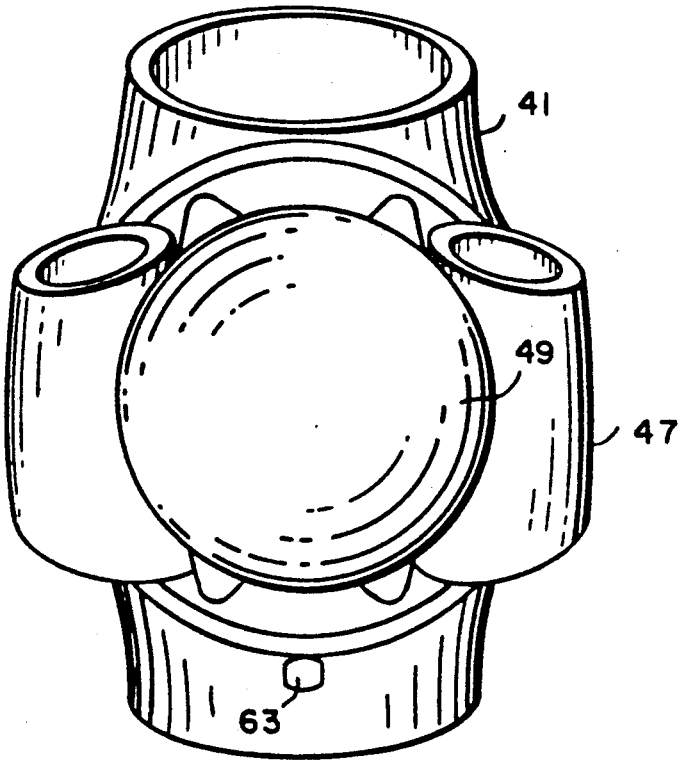
FIG. 4 is a front view of the bracket of FIG. 2.

Referring now to the cross-sectional view of FIG. 3, it can be seen that a shaft 51 extends horizontally from the base 41. The angle at which the shaft extends from the base can be adjusted, i.e., to accommodate for different backstay angles, by means of an adjustment arm 53 which is provided for receiving the left hand end of the shaft.

The shaft 51 and adjustment arm 53 are pivotable around a pin 55 which extends into the base 41. The arm 53 includes a downwardly projecting extension 55 which carries and adjustment screw 57 which is in turn received within a shaped cavity 59 in the base casting 41. Adjustment screw 57 can be rotated by means of a hex socket 61 accessible through an opening 63 in casting 41. The socket end of the adjustment screw is essentially spherical and a separate spherical tip 65 is provided at the other end of the adjustment screw, longitudinal resilience being provided by means of a elastomeric bushing 67. The cavity 59 is provided wit matching cylindrical surfaces as shown so that the adjustment screw exhibits essentially no axial play within the cavity. Accordingly, by rotating the adjustment screw, the angle of the arm 53 and thus of the shaft 51 may be altered.

The rotatable housing assembly 45 is mounted on the shaft 51 by means of bearing 71 and 73, a seal being provided as indicated at 75. As may be seen, the right hand portion of the housing 45 provides an annular chamber surrounding at least a Portion of the shaft 51. In the embodiment illustrated, the housing 49 provides a complete cylinder which is then partially blocked by means of a vane 77 secured between the two portions of the rotatable housing by means of a roll pin 79. The resultant discontinuous chamber is then divided into two regions by a vane 81 which is secured to the stationary horizontal shaft 51. As will be understood, the relative sizes of the two regions will depend upon the angular position of the rotatable housing 45 with respect to the stationary shaft 51.

The divided chamber is filled with a viscous liquid and a restricted communication is provided between the two regions, e.g., by means of a defined port through one of the vanes or simply by providing clearance between one of the vanes and the adjacent, relatively rotatable surface. Accordingly, passage of the fluid back and forth between the two regions provides viscous damping of relative rotation of the housing 45 with respect to the shaft 51. While the particularly embodiment illustrated employs a shaft which is fixed with respect to the sailboat and an antenna receiving housing which is rotatable with respect to the shaft 51, it should be understood that the shaft might rotate with the antenna bracket while the chamber defining housing is fixed with respect to the vessel.

As may be seen from FIG. 2, the antenna 35 is mounted with its center of gravity below the pivot axis. The pivot axis is essentially horizontal and is on a fore-and-aft line with respect to the vessel. Accordingly, as the vessel heels during sailing, the radar antenna will be maintained in a generally level orientation so that radar viewing to the sides is not occluded by the antenna being aimed upwardly or downwardly beyond the vertical beamwidth of the major transmitted lobe. Since the antenna is free to pivot about only one axis and is well damped for rotation around that axis, the antenna is not subject to uncontrolled swinging as would be the case if it were pivoted about multiple axes or not appropriately damped, particularly in the case of smaller sailboats which are subject to relatively short motions in rough seas.

Although sailboats are subject to some pitching, the angle of such motions is typically much smaller than the angles encountered through heeling e.g., particularly when sailing to windward and these pitch angles are typically not sufficient to cause the horizon to be occluded to the front or rear. Thus, contrary to conventional wisdom, an antenna mount with but a single degree of freedom has been found to be highly advantageous. Further, since the antenna mount of the present invention is self leveling, the antenna itself can be designed with a relatively narrow vertical beamwidth, e.g., 12 degree rather than the usual 24. As will be understood by those skilled in the art, a halving of the vertical beam width will essentially quadruple the gain of the system since the gain is doubled both on transmit and on receive.

Figure 7:
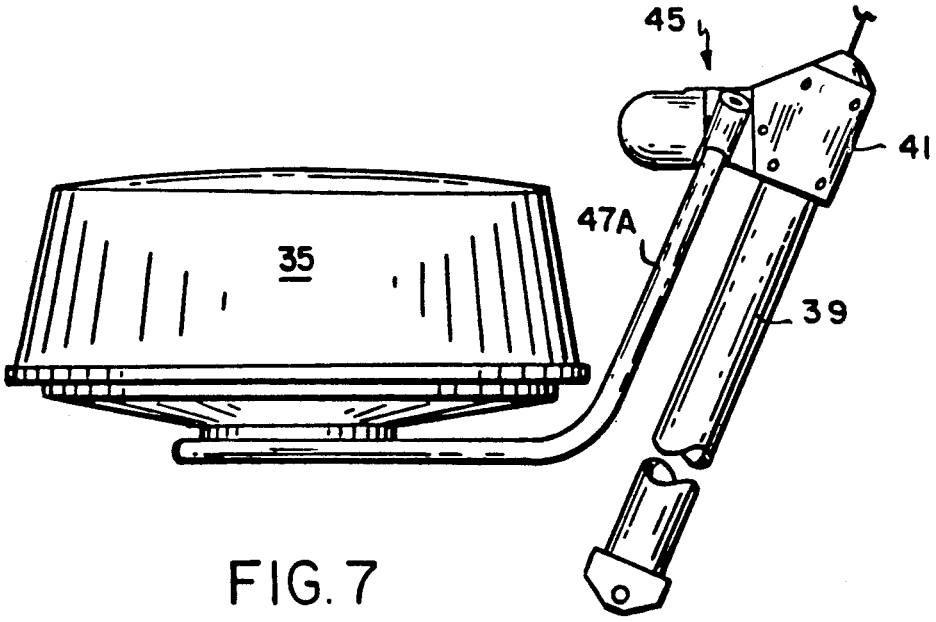
FIG. 7 is a sideview of another embodiment of a mounting bracket according to the present invention, providing mounting of a radar antenna aft of a backstay; and Corresponding reference characters indicate corresponding parts throughout the several view of the drawings.

While positioning of the antenna forward of the backstay is preferably in many instances, it may also be desirable in some circumstances to mount the antenna aft of the backstay, e.g., so as to eliminate possible fouling by an unrestrained topping lift. As is illustrated in FIG. 7, such an arrangement is relatively easily implemented by merely inverting the base casting. Further, although backstay mounting provides many advantages as noted hereinbefore, the advantages of limited single axis rotation with damping is advantageous even if mast mounting is required as may be the case in some circumstances.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A self leveling mount for mounting a radar antenna having a center of gravity on a sailing vessel subject to heeling, said mount comprising:

a shaft on a fore-and-aft horizontal axis relative to said vessel;

pivotally mounted on said shaft, a housing forming an annular chamber around at least a portion of said shaft;

a viscous fluid in said chamber;

vane means on said shaft dividing said chamber into two regions, the relative sizes of said regions being variable as a function of the angular position of said housing relative to said shaft, there being restricted communication between said regions; and means for mounting said antenna on one of said shaft and housing with the center of gravity of the antenna being below said axis and for fixedly attaching the other of said shaft and housing to said vessel.

2. A mount as set forth in claim 1 wherein said vessel is provided with a vertically inclined backstay and the mount further comprises a tube surrounding the lower portion of said backstay and said shaft is mounted at the upper end of said tube.

3. A mount as set forth in claim 2 further comprising means for adjusting the axis of said shaft relative to the angle of the backstay.

4. A mount as set forth in claim 1 wherein said antenna has a vertical beamwidth of about twelve degrees.

5. Apparatus for mounting a radar antenna on a sailing vessel having at least one mast and an inclined backstay extending between the vessel and a mast top, said apparatus comprising:

a tube of substantially larger diameter than said backstay surrounding a substantial part of the lower portion of said backstay;

means securing the lower end of said tube to the vessel thereby to prevent rotation of the tube around the backstay; and secured to the upper end of said tube, a bracket projecting horizontally for receiving a radar antenna.

6. Apparatus as set forth in claim 5 further comprising means for adjusting the angle of said bracket with respect to said backstay.

7. A self leveling mount for mounting a radar antenna having a center of gravity on a sailing vessel having at least one mast and a stay extending between the vessel and a mast top, the vessel being subject to heeling, said mount comprising;

a tube surrounding the lower portion of said stay and being secured to the vessel to prevent rotation around the stay;

a shaft;

pivotally mounted on said shaft, a housing;

means for providing viscous damping of relative rotational movement between said shaft and said housing; and means for mounting said antenna on one of said shaft and housing with the shaft being on a fore-and-aft horizontal axis relative to said vessel and with the center of gravity of the antenna being below said axis for fixedly attaching the other of said shaft and housing to the upper end of said tube.

8. A self leveling radar antenna assembly for use on a sailing vessel subject to heeling, said assembly comprising:

a shaft on a fore-and-aft horizontal axis relative to said vessel;

pivotally mounted on said shaft, a housing;

means for providing viscous damping of relative rotational movement between said shaft and said housing;

a radar antenna having a center of gravity and providing a vertical beamwidth in the order of twelve degrees; and means for mounting said antenna on one of said shaft and housing with the center of gravity of the antenna being below said axis and for fixedly attaching the other of said shaft and housing to said vessel.

9. An assembly as set forth in claim 8 wherein said vessel is provided with an inclined backstay and the mount further comprises a tube surrounding the lower portion of the backstay and said shaft is mounted at the upper end of said tube.

10. An assembly as set forth in claim 9 further comprising means for adjusting the axis of said shaft relative to the angle of the backstay.

11. A self leveling mount for mounting a radar antenna having a center of gravity on a sailing vessel having at least one mast and a backstay extending between the vessel and a mast top, the vessel being subject to heeling, said apparatus comprising:

a tube surrounding the lower portion of said backstay and being secured to the vessel to prevent rotation around the backstay;

at the upper end of said tube, a shaft on a fore-and-aft horizontal axis relative to said vessel;

pivotally mounted on said shaft, a housing forming an annular chamber around at least a portion of said shaft;

a viscous fluid in said chamber;

vane means on said shaft dividing said chamber into two regions, the relative sizes of said regions being variable as a function of the angular position of said housing relative to said shaft, there being restricted communication between said regions; and means for mounting said antenna on one of said shaft and housing with the center of gravity of the antenna being below said axis and for fixedly attaching the other of said shaft and housing to the upper end of said tube.

12. A mount as set forth in claim 11 wherein said antenna has a vertical beamwidth of about twelve degrees.

* * * * *